US006403202B2

(12) United States Patent
Gu et al.

(10) Patent No.: US 6,403,202 B2
(45) Date of Patent: Jun. 11, 2002

(54) RECORDING MATERIAL WITH AN EXTRUSION COATED PVA LAYER

(75) Inventors: Jiren Gu, Syracuse; Sanford K. Lauderback, Jamesville, both of NY (US)

(73) Assignee: Felix Schoeller Technical Papers, Pulaski, NY (US)

( * ) Notice: Subject to any disclaimer, the term of this patent is extended or adjusted under 35 U.S.C. 154(b) by 0 days.

(21) Appl. No.: 09/827,047

(22) Filed: Apr. 5, 2001

Related U.S. Application Data

(63) Continuation of application No. 09/227,075, filed on Jan. 5, 1999, now abandoned.

(51) Int. Cl.[7] ..... B05D 5/04; B41M 5/00

(52) U.S. Cl. ..... 428/211; 428/195; 428/522; 156/129; 427/362; 427/407.1; 427/411

(58) Field of Search ..... 428/195, 211, 428/522; 156/129; 427/362, 407.1, 411

(56) References Cited

U.S. PATENT DOCUMENTS

2002/0001697 A1 * 1/2002 Xing et al.

FOREIGN PATENT DOCUMENTS

EP 0 696 516 A1 * 2/1996

* cited by examiner

*Primary Examiner*—Pamela R. Schwartz
(74) *Attorney, Agent, or Firm*—Cook, Alex, McFarron, Manzo, Cummings & Mehler, Ltd.

(57) ABSTRACT

A recording material for the ink-jet printing method comprises a raw base paper, an extrudable polyvinyl alcohol containing layer which is extruded on the raw base paper, and an ink-receiving layer which is applied as an aqueous dispersion or solution.

8 Claims, No Drawings

RECORDING MATERIAL WITH AN EXTRUSION COATED PVA LAYER

RELATED APPLICATION

This application is a continuation of application Ser. No. 09/227,075 filed Jan. 5, 1999 now abandoned.

BACKGROUND, SUMMARY AND DESCRIPTION OF THE INVENTION

The invention relates to a recording material for the ink-jet printing process.

The ink-jet recording method is used to produce color graphics, full-color copies and also for text printings, so it covers a very wide field of applications. The recording material must fulfill various requirements are made of this recording material, such as high gloss, good drying, high color density, good wet rub-off properties, low mottle, and high water fastness.

The ink-jet recording method is used to produce color graphics, full-color copies and also for text printings, so it covers a very wide field of applications. The recording material must fulfill various requirements that are made of this recording material, such as high gloss, good drying, high color density, good wet rub-off properties, low mottle, and high waterfastness.

High-performance ink-jet printers for producing photographic-quality printings use inks with a high water content as solvent. In addition, the ink application volume by these printers is greater than that with traditional ink-jet printers. Films were initially used as ink-receiving materials, because they are characterized by a high dimensional stability when wetted with water, but they have poor drying properties. One possibility of producing glossy, photographic-quality ink-jet printings is the use of resin-coated papers that are provided with an ink-receiving layer. DE 19 618 607 A describes the use of polyolefin-coated papers to achieve high gloss values. However, the long drying time of these papers is a disadvantage, because with this material the ink fluid cannot be diverted into the paper support. The resin coating acts as a barrier layer with respect to the ink fluid.

The object of the invention is to provide a recording material for the ink-jet printing method, which provides images with a high color density, good wet rub-off fastness, good water fastness, low mottle and beyond that rapid drying after printing with aqueous ink and high gloss.

This object is achieved by a recording material which comprises a raw base paper, a layer containing polyvinyl alcohol (PVA) extruded on the raw base paper, and an ink-receiving layer applied from an aqueous dispersion or solution.

The recording materials according to the invention show a very good adhesion of the PVA layer on the raw base paper, brilliant gloss after calendering or treatment in a chill roll and excellent drying properties after printing with aqueous inks. The drying properties are particularly improved in view of ink-jet recording materials which have a polyolefin layer formed on the paper support. A pretreatment of the raw base paper in order to improve adhesion of the PVA layer on the raw base paper by corona treatment or flame treatment or applying a separate adhesive layer between the paper and the PVA layer is not necessary.

Polyvinyl alcohols which may be used according to the invention are all polyvinyl alcohols which are extrudable or which are made extrudable by the addition of appropriate additives such as plasticizers. Polyvinyl alcohols which may be used according to the invention are in particular polyvinyl alcohol homopolymers, polyvinyl alcohol copolymers and/or mixtures thereof. Suitable PVA copolymers are in particular those which contain ethylene and/or vinyl acetate as polymerizable monomers.

According to a preferred embodiment of the invention, the polyvinyl alcohol is hydrolyzed to an extent of 75 to 99 mol %, and it may have a degree of polymerisation of 200 to 2500. The melt flow index (MFI) of the polyvinyl alcohol resins to be used according to the invention may be 10 to 50 g/10 minutes, preferably 20 to 30 g/10 minutes. The extruded layer containing polyvinyl alcohol may contain 5 to 95 wt % of the extrudable polyvinyl alcohol.

Additives which improve the extrusion properties of the polyvinyl alcohol are, for example, plasticizers. A plasticizer may be incorporated into the polymer matrix during the preparation of the polyvinyl alcohol or may simply be added to the extruder and mixed therein with the polyvinyl alcohol. Suitable plasticizers are all PVA compatible plasticizers such as hydrophylic plasticizers. Suitable plasticizers are in particular polyhydric alcohols, such as glycerol, polyethylene glycol, ethylene glycol, diethylene glycol and mannitol. The plasticizer or a plasticizer mixture containing several plasticizers may amount to 1 to 30 wt %, preferably 5 to 20 wt %, based on the weight of the extrusion coated layer.

Polymers or copolymers which may be included in the layer which is extruded on the raw base paper may contain, for example, polyurethanes, polyolefins, ethylene copolymers, polyalkylene oxides, such as polyethylene oxyethanol, polycarbonates, polyesters, polyamides and polyesteramides.

The PVA layer extruded on the raw base paper may contain those additives which are usually contained in the polyolefin coating of photobase papers. These are in particular white pigments, color pigments, colorants, fillers, optical brighteners and phosphoric acid which is used to improve thermal stability of PVA. A conventional white pigment is titanium dioxide. Further fillers and pigments are calcium carbonate, ultramarine, cobalt blue, carbon black, alumina and silica. In particular, silica is useful for shortening the time required for drying of the ink.

The coating weight of the extruded layer may be 10 to 60 $g/m^2$, preferably 20 to 40 $g/m^2$. The extrusion on the raw base paper is performed according to methods which are known to the skilled worker in the paper manufacturing industry. The extruder is, for example, a screw extruder. According to a preferred embodiment of the invention, the temperature in the extruder or the temperature in different sections of the extruder is adjusted to 140 to 230° C., in particular 160 to 180° C. In particular, in a two-inch extruder it is preferred to compound the resins and further optional additives with screw speeds of more than 50 rpm, in particular more than 75 rpm, and to extrude the resulting mixtures. If an extruder other than a two-inch extruder is used, it is preferred to adjust the screw speed in such a way that the viscosity of the material to be extruded corresponds to the viscosity of a material which is compounded and extruded in a two inch screw extruder at screw speeds of more than 50 rpm and a temperature of 140 to 230° C.

In order to achieve high gloss it is preferred to use a high gloss chill roll. Very good gloss results are also obtained with the chill rolls of DE 198 12 445.

As support material any kind of raw base paper may be used. Preferably surface sized papers, calendered or non-calendered papers or highly sized raw base papers may be used. The raw base paper may be sized with acidic or neutral sizing agents. Especially suitable are papers with a surface roughness of less than 300 Sheffield units determined according to Tappi T538 roughness. The raw base paper shall have a high dimensional stability and should be able to absorb the water which is contained in the ink without formation of curl. Papers with a high dimensional stability which are manufactured from pulp mixtures, comprising softwood sulphate fiber pulp and eucalyptus pulp are particularly suited. The disclosure of DE 196 02 793 B1, which discloses a raw base paper for a ink-jet recording material, is incorporated herein by reference.

According to a preferred embodiment the raw base paper is not too strongly sized in order to allow a paper surface with an open pore structure. Particularly preferred papers are those having a roughness of less than 200 Sheffield units. The basis weight of the raw base paper may be 60 to 250 g/m$^2$.

The raw base paper may contain further additives which are conventional in the paper manufacturing industry such as colorants, optical brighteners, pigments, and defoaming agents. It is also possible to use waste pulp and processed recycled paper.

Onto the extruded PVA layer any known ink receiving layer may be applied from an aqueous phase, for example, by means of a blade or a coating knife. The ink receiving layer may be applied as a single layer or multiple layers. The ink-receiving layer may contain inorganic and/or organic pigments such as titanium dioxide, silica, alumina, calcium carbonate, boehmite, bentonite, polyamide, polyesters, polyolefins and olefin copolymers. Preferably, no pigments are used in the ink-receiving layer. If the ink-receiving layer shall contain pigments, the amount of pigments should not exceed about 10 wt %, based on the weight of the dry ink-receiving layer in order not to adversely affect the gloss of the image. If nano-sized pigments with an organic coating are used in the ink-receiving layer their amount may exceed 10 wt %. Additionally, the ink-receiving layer may contain a hydrophilic binder, such as a water soluble polyvinyl alcohol, dye fixing agents, colorants and optical brighteners.

Surprisingly, it was found that by applying the ink-receiving layer as an aqueous dispersion or aqueous solution, the adhesion of the extruded PVA layer to the paper is distinctly improved. It is assumed that the adhesion is improved because of the migration of water into the PVA layer and the softening of the polyvinyl alcohol at the border layer of the paper and the subsequent drying process. The coating weight of the ink-receiving layer may be 0.1 to 10 g/m$^2$, preferably 1 to 2 g/m$^2$.

In order to adjust curl, antistatic properties and feed properties in the printer, on the back side of the raw base paper there may be provided a separate function layer. Especially suitable back side layers are described in DE43 08 274 A1 and DE 44 28 941 A1 which are incorporated herein by reference.

The following examples shall further explain the invention.

Raw base papers were produced as follows:

Raw Base Paper A

A paper with a basis weight of 83 g/m$^2$ and a Thickness of 87 $\mu$m was produced on a Fourdrinier paper machine. The pulp used had a degree of beating of 29 according to Schopper-Riegler. The pulps used were approximately 42 wt % pine kraft pulp and approximately 54 wt % eucalyptus pulp. In addition, 4 wt % clay was added as pigment. The sizing agent added was 0.1 wt % alkylketene dimer (Aquapel® C526) and 0.05 wt % starch, and the wet strength agent was 0.5 wt % poly(aminoamide)-epichlorohydrin resin (Kymene® 617 HP). A 7.0 wt % polyvinyl alcohol solution (Moviol® 10–98) was used as surface sizing agent. The paper had a roughness of 98 according to Sheffield.

Raw Base Paper B

A paper with a basis weight of 130 g/m$^2$ and a thickness of 138 $\mu$m was produced on a Yankee machine. The pulps had a degree of beating of 27 according to Schopper-Riegler. Approximately 24.5 wt % pine kraft pulp and approximately 67 wt % eucalyptus pulp were used as pulp. Clay was added in an amount of 8.5 wt % as the pigment. The sizing agent added was 0.055 wt % alkylketene dimer (Aquapel® C526) and the wet strength agent added was 0.6 wt % poly (aminoamide)-epichlorohydrin resin (Kymene® 617 HP). For the surface sizing, a 1.97 wt % Emox® TSC starch solution was used. The paper had a roughness of 120 according to Sheffield.

Raw Base Paper C

A paper with a basis weight of 174 g/m$^2$ and a thickness of 167 $\mu$m was produced on a Fourdrinier paper machine. The pulps had a degree of beating of 30 according to Schopper-Riegler. The pulps used included 31.25 wt % maple kraft pulp and 68.75 wt % mixed short-fiber hardwood kraft pulp. The sizing agents added were 0.446 wt % alkylketene dimer (Aquapel® C526) and 1.32 wt % starch, and the wet strength agent was 0.326 wt % poly (aminoamide)-epichlorohydrin resin (Kymene® 617 HP). A 6.0 wt % Emox® TSC starch solution was used for surface sizing. This paper had a roughness of 200 according to Sheffield.

Raw Base Paper D

A paper with a basis weight of 136 g/m$^2$ and a Thickness of 147 $\mu$m was produced on a Fourdrinier paper machine. The pulps had a degree of beating of 33 according to Schopper-Riegler. The pulp used was 13.0 wt % maple kraft pulp and 87.0 wt % mixed short-fiber hardwood kraft pulp.

The sizing agent added was 0.64 wt % starch and 0.64 wt % stearate. A 6.0 wt % Emox® TSC starch solution was used for the surface sizing. The paper had a roughness of 155 according to Sheffield.

The amounts given for the weight of the pulps and pigments are based on the pulper furnish of these substances; the amounts given for the weight of sizing agents and wet strength agents are based on the dry fiber content.

The ink-receiving layer applied in Examples 1 to 8 was applied as an aqueous dispersion which is subsequently dried by conventional means. This ink-receiving layer had the following composition:

| | |
|---|---|
| polyvinyl alcohol degree of saponification 80% Moviol ® 4-80) | 80 wt % |
| polyvinylpyrrolidone PVP K-90 ®) | 10 wt % |
| cationic polymer (Percol ® 402) | 5 wt % |
| cationic aminomethacrylate copolymer (Induquat ® ECR 69/956) | 5 wt % |

The weight amounts are based on the dried layer. The ink-receiving layer can be applied with all conventional coating methods.

EXAMPLE 1

Raw base paper A was coated with Vinex® 2019, an extrudable PVA copolymer from Air Products, by means of a 2" extruder, maintaining a temperature profile of 160° C., 177° C., 196° C., 210° C. and 216° C. in the extruder. To improve the adhesion of the PVA layer, the screw speed should be more than 50 rpm. Very good adhesion results were achieved with a screw speed of 75 rpm. A small air gap and a higher coating weight of the PVA layer also have a positive effect on adhesion. To achieve the highest possible gloss values, a high-gloss chill roll was used. The coating weight of the extruded PVA layer was 20 g/m$^2$. On the PVA coated paper the aforementioned ink-receiving layer was applied.

EXAMPLE 2

Raw base paper B was extrusion-coated with Vinex® 2019, a polyvinyl alcohol copolymer from Air Products, under the same conditions as in Example 1. The coating weight of the extruded PVA layer was 26 g/m$^2$. On the PVA coated paper the aforementioned ink-receiving layer was applied.

EXAMPLE 3

Raw base paper C was extrusion-coated with Vinex® 2019, a polyvinyl alcohol copolymer from Air Products, under the same conditions as in Example 1. The coating weight of the extruded PVA layer was 31 g/m$^2$. On the PVA coated paper the aforementioned ink-receiving layer was applied.

EXAMPLE 4

Raw base paper D was extrusion-coated with Vinex® 2019, a polyvinyl alcohol copolymer from Air Products, under the same conditions as in Example 1. The coating weight of the extruded PVA layer was 28 g/m$^2$. On the PVA coated paper the aforementioned ink-receiving layer was applied.

EXAMPLE 5

Raw base paper A was extrusion-coated with Ecomaty®, a polyvinyl alcohol from Nippon Gohsei, under the same conditions as in Example 1. The coating weight of the extruded PVA layer was 22 g/m$^2$. On the PVA coated paper the aforementioned ink-receiving layer was applied.

EXAMPLE 6

Raw base paper B was extrusion-coated with Ecomaty®, a polyvinyl alcohol from Nippon Gohsei, under the same conditions as in Example 1. The coating weight of the extruded PVA layer was 25 g/m$^2$. On the PVA coated paper the aforementioned ink-receiving layer was applied.

EXAMPLE 7

Raw base paper C was extrusion-coated with Ecomaty®, a polyvinyl alcohol from Nippon Gohsei, under the same conditions as in Example 1. The coating weight of the extruded PVA layer was 26 g/m$^2$. On the PVA coated paper the aforementioned ink-receiving layer was applied.

EXAMPLE 8

Raw base paper C was extrusion-coated with Ecomaty®, a polyvinyl alcohol from Nippon Gohsei, under the same conditions as in Example 1. The coating weight of the extruded PVA layer was 29 g/m$^2$. On the PVA coated paper the aforementioned ink-receiving layer was applied.

COMPARATIVE EXAMPLE 1

A conventional commercial ink-jet paper with a polyolefin-coated paper as the carrier material was used as Comparative Example 1.

COMPARATIVE EXAMPLE 2

Raw base paper C was extrusion-coated on the front side with a low-density polyethylene (LDPE) with a titanium dioxide content of 10 wt % and on the back side with a clear LDPE. The front side coating weight was 19 g/m , and the back side coating weight was 22 g/m$^2$.

A PVA was applied to the coated front side according to Example 1 with a coating weight of 22 g/m$^2$. This PVA layer also served as the ink-receiving layer.

COMPARATIVE EXAMPLE 3

Example 1 without the additional ink-receiving layer was used as Comparative Example 3.

Using a conventional commercial Hewlett Packard HP 850C ink-jet printer and the corresponding inks, a test image was printed on the recording material. This test image was tested for color density, unevenness (mottle), wet rub-off fastness, waterfastness and gloss. The results are summarized in Tables 1 through 3.

Color density:

The color density was measured in reflection on the colors cyan, magenta, yellow and black with an X-Rite model 428 densitometer.

Unevenness (mottle):

The unevenness or cloudiness in a colored area was evaluated visually with a grade of 1 to 6 (very good to very bad).

Water fastness:

The printed papers were placed in warm water at 25° C. for one minute and dried. The color density was measured before and after wetting. The remaining color density was given in percent.

Wet rub-off fastness:

The wet rub-off fastness was tested in the black parts of the image by rubbing off the print image with a white cloth one minute after printing and then evaluating with a grade of 1 to 3. A grade of 1 means no color residues on the cloth, a grade of 2 means some color residues on the cloth, and a grade of 3 means a great deal of color residue on the cloth.

Gloss:

The gloss was measured according to DIN 67,530 and ASTM D 523 at an angle of 60° using a gloss meter from Dr. Lange GmbH. The measurement was performed on the unprinted recording material.

Adhesion:

To evaluate the adhesion, the PVA layer was peeled away from the paper substrate. The peeling behavior was evaluated with a grade of 1 to 3. A grade of 1 means that the PVA film can be separated from the paper substrate only in tiny pieces. A grade of 2 means that it is difficult to separate the film from the substrate and that fibers adhere to the film. A grade of 3 means that the film can easily be separated from the substrate and that few or no fibers adhere to the film.

TABLE 1

| Sample | Gloss | Adhesion | Mottle |
|---|---|---|---|
| Ex. 1 | 85.8 | 1 | 1 |
| Ex. 2 | 85.2 | 1 | 1 |
| Ex. 3 | 83.9 | 1 | 1 |
| Ex. 4 | 84.7 | 1 | 1 |
| Ex. 5 | 85.6 | 1 | 1 |
| Ex. 6 | 85.3 | 1 | 1 |
| Ex. 7 | 83.8 | 1 | 1 |
| Ex. 8 | 84.5 | 1 | 1 |
| Comp. Ex. 1 | 85.9 | — | 1 |
| Comp. Ex. 2 | 82.8 | 2 | 3 |
| Comp. Ex. 3 | 84.3 | 2 | 1–2 |

TABLE 2

| | Wet rub-off | Waterfastness in % | | | |
|---|---|---|---|---|---|
| Sample | fastness | cyan | magenta | yellow | black |
| Ex. 1 | 1 | 98.7 | 84.9 | 98.5 | 98.5 |
| Ex. 2 | 1 | 98.3 | 84.7 | 98.8 | 98.2 |
| Ex. 3 | 1 | 98.2 | 85.1 | 98.5 | 98.6 |
| Ex. 4 | 1 | 98.8 | 84.1 | 98.3 | 98.5 |
| Ex. 5 | 1 | 98.7 | 84.5 | 98.6 | 98.2 |
| Ex. 6 | 1 | 99.0 | 84.3 | 98.2 | 98.1 |
| Ex. 7 | 1 | 98.7 | 84.4 | 98.3 | 98.4 |
| Ex. 8 | 1 | 98.5 | 84.2 | 98.1 | 98.00 |
| Comp. Ex. 1 | 2 | 96.1 | 82.5 | 96.3 | 95.8 |
| Comp. Ex. 2 | 2 | 96.4 | 82.9 | 96.4 | 96.1 |
| Comp. Ex. 3 | 2 | 96.5 | 82.3 | 97.0 | 97.1 |

TABLE 3

| | Determination of color density | | | |
|---|---|---|---|---|
| Sample | Cyan | Magenta | Yellow | Black |
| Ex. 1 | 2.08 | 1.23 | 1.40 | 1.95 |
| Ex. 2 | 2.07 | 1.25 | 1.42 | 1.98 |
| Ex. 3 | 2.10 | 1.22 | 1.39 | 1.95 |
| Ex. 4 | 2.07 | 1.27 | 1.40 | 1.96 |
| Ex. 5 | 2.06 | 1.25 | 1.43 | 1.96 |
| Ex. 6 | 2.09 | 1.25 | 1.44 | 1.97 |
| Ex. 7 | 2.06 | 1.23 | 1.43 | 1.96 |
| Ex. 8 | 2.04 | 1.23 | 1.41 | 1.94 |
| Comp. Ex. 1 | 2.02 | 1.20 | 1.38 | 1.95 |
| Comp. Ex. 2 | 1.98 | 1.11 | 1.31 | 1.87 |
| Comp. Ex. 3 | 2.00 | 1.15 | 1.32 | 1.85 |

These examples show that a high-gloss recording material with good results with regard to color density, wet rub-off fastness, waterfastness and mottle is obtained by extrusion of a polyvinyl alcohol on the raw base paper. It should be noted that good results are achieved in all tests.

What is claimed is:

1. A recording material for the ink-jet printing method, comprising a raw base paper, a layer which is extruded onto the raw base paper, said layer containing an extrudable polyvinyl alcohol, and an ink-receiving layer which is applied as an aqueous dispersion or solution.

2. The recording material according to claim 1, wherein the polyvinyl alcohol is a polyvinyl alcohol homopolymer, a polyvinyl alcohol copolymer and/or a mixture thereof.

3. The recording material according to claim 1, wherein the polyvinyl alcohol is hydrolyzed to an extent of 75 to 99 mol %.

4. The recording material according to claim 1, wherein the polyvinyl alcohol degree of polymerization is about 200 to 2500.

5. The recording material according to claim 1, wherein the extruded layer contains a polyvinyl alcohol resin with a melt flow index of about 10 to 50 g/10 minutes.

6. The recording material according to claim 1, wherein the polyvinyl alcohol containing layer comprises further polymers or copolymers selected form the group consisting of polyurethanes, polyolefins, ethylene copolymers, polyalkyleneoxides, polycarbonates, polyesters, polyamides and polyesteramides.

7. The recording material of claim 6, wherein the polyalkyleneoxides include polyethylene oxyethanol.

8. A method for the manufacture of a recording material for the ink-jet printing process, wherein an extrudable polyvinyl alcohol homopolymer and/or copolymer is applied by melt extrusion onto a raw base paper with a surface roughness according to Sheffield of less than 300, the section temperatures of the extruder are adjusted to 140° C. to 230° C., the screw speed is adjusted such that the viscosity of the melt of the polyvinyl alcohol corresponds to the viscosity in a two-inch screw extruder at a temperature of 140 to 230° C. and a screw speed of more than 50 rpm, the molten polyvinyl alcohol film runs into a gap between the surface of the paper and a high-gloss chill roll, and wherein an ink-receiving layer is applied to the extruded PVA layer as an aqueous solution or an aqueous dispersion.

* * * * *

UNITED STATES PATENT AND TRADEMARK OFFICE

CERTIFICATE OF CORRECTION

PATENT NO. : 6,403,202 B2 
DATED : June 11, 2002
INVENTOR(S) : Jiren Gu and Sanford K. Lauderback It is certified that error appears in the above-identified patent and that said Letters Patent is hereby corrected as shown below:

Column 1,
Lines 13-19, delete the paragraph "The ink-jet . . . . water fastness."
Lines 42-43, between the paragraphs ending in "the ink fluid." and beginning with "The object", insert the following paragraph:
-- Another possibility of obtaining glossy recording materials is to use cast-coated papers. With these papers, the substrate is provided with an aqueous pigment-containing layer, pressed against a high-gloss cylinder and dried. --

Column 6,
Line 15, change "19 g/m" to -- $19g/m^2$ --.

Signed and Sealed this

Eleventh Day of May, 2004

JON W. DUDAS
*Acting Director of the United States Patent and Trademark Office*